US010950159B1

(12) United States Patent
Tsai et al.

(10) Patent No.: US 10,950,159 B1
(45) Date of Patent: Mar. 16, 2021

(54) INFORMATION DISPLAY METHOD AND INFORMATION DISPLAY SYSTEM

(71) Applicant: Industrial Technology Research Institute, Hsinchu (TW)

(72) Inventors: Yi-Shou Tsai, Hsinchu (TW); Shin-Hong Kuo, New Taipei (TW); Yu-Hsiang Liu, Chiayi (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 16/686,220

(22) Filed: Nov. 18, 2019

(30) Foreign Application Priority Data

Sep. 4, 2019 (TW) ..... 108131964 A

(51) Int. Cl.
*G09G 5/02* (2006.01)
*G09G 3/20* (2006.01)

(52) U.S. Cl.
CPC ..... *G09G 3/2003* (2013.01); *G09G 2320/066* (2013.01); *G09G 2320/0666* (2013.01)

(58) Field of Classification Search
CPC ..... G06T 15/503; G06T 11/001; G06T 11/60; G09G 2340/10; G09G 5/393
USPC ..... 345/592
See application file for complete search history.

(56) References Cited

U.S. PATENT DOCUMENTS

| | | | |
|---|---|---|---|
| 9,809,165 | B1 | 11/2017 | Misu et al. |
| 10,217,392 | B2 | 2/2019 | Yu et al. |
| 10,283,085 | B2 | 5/2019 | Imai |
| 2013/0314433 | A1 | 11/2013 | Ko |

(Continued)

FOREIGN PATENT DOCUMENTS

| | | |
|---|---|---|
| CN | 104956428 | 4/2018 |
| CN | 109471535 | 3/2019 |

(Continued)

OTHER PUBLICATIONS

Legge, G. E., etc. Psychophysics of Reading: XI, Comparing Color Contrast and Luminance Contrast, J. Optical Soc. Am. Nov. 1990 . [Online], [Retrieved on Jul. 1, 2020]. Retrieved from the Internet: <URL: https://www.researchgate.net/publication/20925172> (Year: 1990).*

(Continued)

*Primary Examiner* — Gordon G Liu
(74) *Attorney, Agent, or Firm* — JCIPRNET

(57) ABSTRACT

An information display method and an information display system are provided. The information display method includes: capturing a background image of an information display area of the transparent display; using critical contrast values and color levels of the background image to calculate a display threshold; using the color levels of the background image and color levels of display information to calculate a recognition evaluation score; and determining whether the recognition evaluation score is greater than or equal to the display threshold. If the recognition evaluation score is greater than or equal to the display threshold, the display information is displayed in the information display area. If the recognition evaluation score is less than the display threshold, an optimized display parameter is calculated by using the display threshold, and optimized display information is displayed in the information display area of the transparent display.

16 Claims, 10 Drawing Sheets

(56) References Cited

U.S. PATENT DOCUMENTS

| | | | | |
|---|---|---|---|---|
| 2016/0163250 | A1 | 6/2016 | Ohishi et al. | |
| 2016/0351164 | A1 | 12/2016 | Hsieh et al. | |
| 2018/0217678 | A1* | 8/2018 | Yun | G09G 3/3208 |
| 2018/0247613 | A1 | 8/2018 | Lee et al. | |
| 2019/0057255 | A1* | 2/2019 | Kuo | G06K 9/00624 |

FOREIGN PATENT DOCUMENTS

| | | |
|---|---|---|
| TW | 201608280 | 3/2016 |
| TW | 201711016 | 3/2017 |
| TW | I576771 | 4/2017 |

OTHER PUBLICATIONS

"Office Action of Taiwan Counterpart Application", dated Jun. 2, 2020, p. 1-p. 5.

* cited by examiner

INFORMATION DISPLAY METHOD AND INFORMATION DISPLAY SYSTEM

CROSS-REFERENCE TO RELATED APPLICATION

This application claims the priority benefit of Taiwan application serial no. 108131964, filed on Sep. 4, 2019. The entirety of the above-mentioned patent application is hereby incorporated by reference herein.

TECHNICAL FIELD

The disclosure relates to an information display method and an information display system. More particularly, the disclosure relates to an information display method and an information display system applied to a transparent display.

BACKGROUND

A transparent display itself has a certain degree of transparency. The transparent display may not only allow a user to view a background on the other side of the transparent display relative to the user, but also display information related to the background. Based on this transparent property, transparent displays may be widely applied in various fields as, for example, building windows, automobile windows, or shop windows.

When a background image and display information are simultaneously displayed on the transparent display, the display information may overlay the background image. When a background luminance is too high or the background image is too complicated, the display information may not be clearly viewed. Therefore, how to improve the recognizability of the display information has become one of the problems that researchers in this field are eager to solve.

SUMMARY

An information display method introduced by an embodiment of the disclosure is used in a transparent display. The information display method includes: capturing a background image of an information display area of the transparent display; calculating a display threshold by using critical contrast values and color levels of the background image; calculating a recognition evaluation score by using the color levels of the background image and color levels of display information; and determining whether the recognition evaluation score is greater than or equal to the display threshold. If the recognition evaluation score is greater than or equal to the display threshold, the display information is displayed in the information display area. If the recognition evaluation score is less than the display threshold, an optimized display parameter is calculated by using the display threshold, and optimized display information is displayed in the information display area of the transparent display.

An information display system introduced by an embodiment of the disclosure includes a transparent display, an image capture module, a database and a calculation module. The image capture module captures a background image of an information display area of the transparent display. The database stores critical contrast values and a luminance-color level conversion curve. The calculation module calculates a display threshold by using critical contrast values and color levels of the background image and calculating a recognition evaluation score by using the color levels of the background image and color levels of display information. The calculation module further determines whether the recognition evaluation score is greater than or equal to the display threshold. If the recognition evaluation score is greater than or equal to the display threshold, the display information is displayed in the information display area. If the recognition evaluation score is less than the display threshold, an optimized display parameter is calculated by using the display threshold, and optimized display information is displayed in the information display area.

Several exemplary embodiments accompanied with figures are described in detail below to further describe the disclosure in details.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

DETAILED DESCRIPTION OF DISCLOSED EMBODIMENTS

Figure 1:
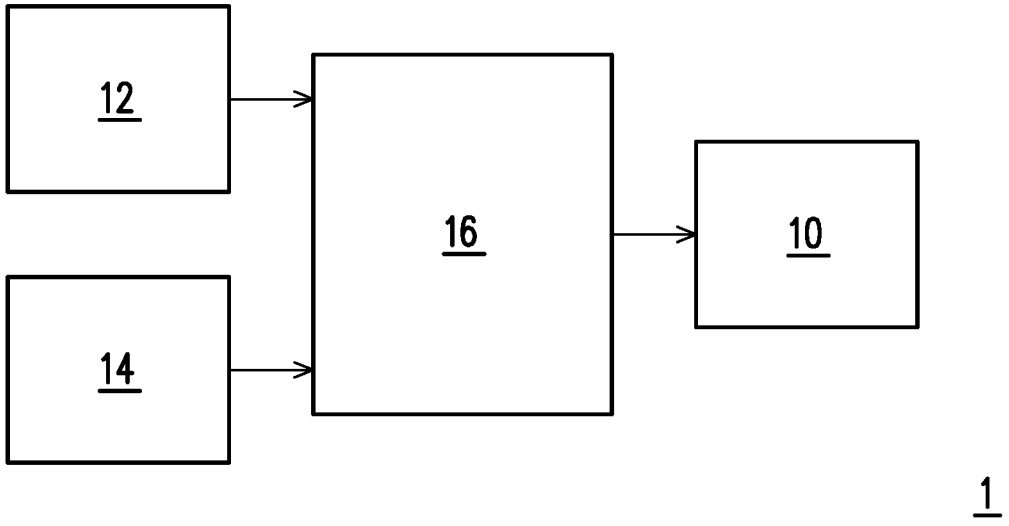
FIG. 1 is a schematic diagram illustrating an information display system according to an embodiment of the disclosure.

In the following embodiments, terms used to indicate directions, such as "up," "down," "front," "back," "left," and "right", merely refer to directions in the accompanying drawings. Thus, the direction languages is used for description, but not intended to limit the scope of the disclosure.

In the accompanying drawings, the drawings illustrate the general features of methods, structures, and/or materials used in the particular exemplary embodiments. However, the drawings should not be interpreted as defining or limiting the scope or nature covered by the exemplary embodiments. For example, for clarity, the relative size, thickness and location of each layer, region and/or structure may be reduced or enlarged.

In the embodiments, the same or similar elements will be designated by the same or similar reference numerals, and related descriptions will be omitted. In addition, the features of different exemplary embodiments may be combined with each other when they are not in conflict, and simple changes and modifications which are made according to the specification or the claims still pertain to the scope of the application.

Terms such as "first" and "second" mentioned throughout the specification or the claims of this application are only for naming the names of the elements or distinguishing different embodiments or scopes and are not intended to limit the upper limit or the lower limit of the number of the elements nor intended to limit manufacturing sequences or disposition sequences of the elements.

FIG. 1 is a schematic diagram illustrating an information display system 1 according to an embodiment of the disclosure. Referring to FIG. 1, the information display system 1 includes a transparent display 10, an image capture module 12, a database 14 and a calculation module 16.

The transparent display 10 refers to a display with a certain degree of light transparency which may allow a user to view a background on the other side of the transparent display relative to the user while outputting display information. In other words, the user may view a background image and display information simultaneously. In the disclosure, the "background image" refers to an image which is viewed by the user on the other side of the transparent display relative to the user. The "display information" refers to a non-background image which is viewed by the user on the transparent display but does not appear on the other side relative to the user. For example, the display image may include texts and/or graphics. Each of the background image and the display information may include display parameters such as a luminance, a size, a position and color levels. Taking an 8-bit color image as an example, each of three primary colors has total 256 color levels from 0 to 255, but the numbers of the color levels and the bit number of the color image are not limited in the disclosure.

The image capture module 12 may capture a background image of an information display area (which is not shown in FIG. 1) of the transparent display 10. For example, the image capture module 12 may include a light detecting device, such as a light detector, a colorimeter, a luminance meter, a spectrometer or an image capture device. The "information display area" refers to an area on the transparent display 10 on which the display information is displayed. The display information and the background image overlay together in the information display area. A method for the image capture module 12 to capture the background image of the information display area may include directly photographing the background image of the information display area from a side where the user is located by using the aforementioned light detecting device, or alternatively, photographing a background image of the entire display area of the transparent display 10 by using the light detecting device and then, capturing the background image in the information display area. In other words, it may be the background image of the entire display area of the transparent display 10 captured, or only the background image in the information display area captured.

The database 14 stores critical contrast values and a luminance-color level conversion curve, but the disclosure is not limited thereto. In an embodiment, the database 14 may further store the user identity, the user preferences or other information. The database 14 may be built in an electronic device or stored in a cloud.

The critical contrast value are, for example, statistically calculated according to monochrome contrast values capable of being clearly recognized by human eyes through a human factor experiment. In other words, when a contrast value is lower than the critical contrast value, it is not easy for the user to recognize the display information. In an example, the human factor experiment is a reading speed experiment which is performed in a condition that three colors, red, green and blue, of the background image and three colors, red, green and blue, of the display information are in different contrasts, thereby finding out reading speed transition points and serving them as critical contrast values. A quadratic curve is fitted from the human factor data to set preferable critical contrast values, more preferable critical contrast values and most preferable critical contrast values according to a slope of the curve (as shown in Table 1). When a contrast value is greater than or equal to a preferable critical contrast value, an ideal display information recognizability may be presented. In addition, when a contrast value is greater than or equal to a most preferable critical contrast value, a best display information recognizability may be presented and meet a range that is easily/quickly recognizable to ordinary users.

TABLE 1

| Critical contrast value code | Color of back-ground image | Colors of display infor-mation | Preferable critical contrast value | More preferable critical contrast value | Most preferable critical contrast value |
|---|---|---|---|---|---|
| RR | Red | Red | 1.138 | 1.188 | 1.256 |
| RG | | Green | 1.190 | 1.244 | 1.402 |
| RB | | Blue | 1.194 | 1.280 | 1.978 |
| GR | Green | Red | 1.084 | 1.156 | 1.236 |
| GG | | Green | 1.146 | 1.352 | 1.482 |
| GB | | Blue | 1.142 | 1.417 | 1.499 |
| BR | Blue | Red | 1.138 | 1.185 | 1.232 |
| BG | | Green | 1.226 | 1.272 | 1.306 |
| BB | | Blue | 1.196 | 1.264 | 1.349 |

According to Table 1, the critical contrast values may include red critical contrast values, green critical contrast values and blue critical contrast values. The red critical contrast values may be further divided into a critical contrast value RR, a critical contrast value RG and a critical contrast value RB. The green critical contrast values may be further divided into a critical contrast value GR, a critical contrast value GG and a critical contrast value GB. The blue critical contrast values may be further divided into a critical contrast value BR, a critical contrast value BG and a critical contrast value BB.

According to Table 1, the critical contrast values, for example, fall within a range from 1.084 to 1.978. When the preferable critical contrast values are used as the critical contrast values, the critical contrast values fall within a range from 1.084 to 1.226. When the more preferable critical contrast values are used as the critical contrast values, the critical contrast values fall within a range from 1.185 to 1.417. When the most preferable critical contrast values are used as the critical contrast values, the critical contrast values fall within a range from 1.232 to 1.978.

The luminance-color level conversion curve may be used to convert a luminance into a color level, or convert a color level into a luminance. The luminance-color level conversion curve is related to design parameters (e.g., white balances, apertures, shutter sizes and so on) of the transparent display 10 and the image capture module 12, which is not particularly limited herein.

The calculation module 16 is coupled to the transparent display 10, the image capture module 12 and the database 14 for signal transmission. The coupling referred to herein may include a wired or a wireless connection manner. For example, the calculation module 16 may include an arithmetic logic unit, a control unit, a memory unit or other required units. The arithmetic logic unit, the control unit and the memory unit may respectively be a central processing unit (CPU), a controller and a temporary memory, but the disclosure is not limited thereto.

The calculation module 16 may calculate a display threshold by using the critical contrast values and the color levels of the background image, and the calculation module 16 may also calculate a recognition evaluation score by using the color levels of the background image and color levels of display information. In an embodiment, the calculation module 16 may convert the color levels (C1R, C1G, C1B) of the background image into first luminance values (L1R, L1G, L1B) and converts the color levels (C2R, C2G, C2B) of the display information into second luminance values (L2R, L2G, L2B). Thereafter, the calculation module 16 may calculate the display threshold by using the critical contrast values and the first luminance values (referring to Formula 1) and calculate the recognition evaluation score by using the first luminance values and the second luminance values (referring to Formula 2). In Formula 1, each of the critical contrast values (e.g., RR, RG, RB, GR, GG, GB, BR, BG or BB) may be selected from one of the preferable critical contrast values, the more preferable critical contrast values and the most preferable critical contrast values of Table 1.

Formula 1:

$$\text{Display threshold} = \frac{L1R*(RR+RG+RB)+L1G*(GR+GG+GB)+L1B*(BR+BG+BB)}{3*(L1R+L1G+L1B)} \quad \text{Formula 1}$$

Formula 2:

$$\text{Recognition evaluation score} = \frac{L2R+L2G+L2B+L1R+L1G+L1B}{L1R+L1G+L1B} \quad \text{Formula 2}$$

According to Formula 2, the recognition evaluation score is calculated by a sum of the first luminance values and the second luminance values divided by the first luminance values.

The calculation module may further determine whether the recognition evaluation score is greater than or equal to the display threshold. If the recognition evaluation score is greater than or equal to the display threshold, the display information is displayed in the information display area. If the recognition evaluation score is less than the display threshold, an optimized display parameter is calculated by using the display threshold, and optimized display information is displayed in the information display area of the transparent display 10. In an embodiment, the optimized display parameter may include third luminance values calculated by using the first luminance values, the second luminance values and the display threshold, and the third luminance values may include a red luminance value L3R (referring to Formula 3), a green luminance value L3G (referring to Formula 4) and a blue luminance value L3B (referring to Formula 5).

Formula 3:

$$L3R = \frac{L2R}{L2R+L2G+L2B}*[\text{Display threshold}*(L1R+L1G+L1B)-(L1R+L1G+L1B)] \quad \text{Formula 3}$$

Formula 4:

$$L3G = \frac{L2G}{L2R+L2G+L2B}*[\text{Display threshold}*(L1R+L1G+L1B)-(L1R+L1G+L1B)] \quad \text{Formula 4}$$

Formula 5:

$$L3B = \frac{L2B}{L2R+L2G+L2B}*[\text{Display threshold}*(L1R+L1G+L1B)-(L1R+L1G+L1B)] \quad \text{Formula 5}$$

The calculation module 16 may further determine whether one of the red luminance value L3R, the green luminance value L3G and the blue luminance value L3B exceeds an upper limit of display. For example, whether the red luminance value L3R exceeds an upper limit of luminance capable of being displayed by a red pixel of the transparent display 10 is determined, whether the green luminance value L3G exceeds an upper limit of luminance capable of being displayed by a green pixel of the transparent display 10 is determined, or whether the blue luminance value L3B exceeds an upper limit of luminance capable of being displayed by a blue pixel of the transparent display 10 is determined.

If none of the red luminance value L3R, the green luminance value L3G and the blue luminance value L3B exceed the upper limit of display, the calculation module 16 converts the third luminance values into color levels and display the optimized display information in the information display area of the transparent display 10. On the other hand, if one of the red luminance value L3R, the green luminance value L3G and the blue luminance value L3B exceeds the upper limit of display, the calculation module 16 may further determine whether all of the luminance values (the red luminance value L3R, the green luminance value L3G and the blue luminance value L3B) of the three primary colors exceed the upper limit of display.

If not all of the red luminance value L3R, the green luminance value L3G and the blue luminance value L3B exceed the upper limit of display (for example, one of the red luminance value L3R, the green luminance value L3G and the blue luminance value L3B does not exceed the upper limit of display), the calculation module 16 may deduct a saturated luminance value and calculate luminance values of the other colors, and the calculation module 16 may further convert the calculated luminance values into color levels to display the optimized display information in the information display area of the transparent display. For example, it is assumed that the red luminance value L3R, the green luminance value L3G and the blue luminance value L3B which are calculated according to Formulas 3 through 5 are 1000 nits, 1000 nits and 0 nits, respectively. If the upper limit of the luminance capable of being displayed by the red pixel of the transparent display 10 is 500 nits, the red luminance value L3R, the green luminance value L3G and the blue luminance value L3B are adjusted as 500 nits, 1500 nits and 0 nits, respectively. If the upper limit of the luminance capable of being displayed by the green pixel of the transparent display 10 is 1000 nits, the red luminance value L3R, the green luminance value L3G and the blue luminance value L3B may be further adjusted as 500 nits, 1000 nits and 500 nits, respectively. If none of the adjusted luminance values exceed the upper limit of display, the calculation module 16 may convert the calculated luminance values (e.g., 500 nits, 1000 nits and 500 nits) into the color levels and display the optimized display information in the information display area of the transparent display.

If all of the red luminance value L3R, the green luminance value L3G and the blue luminance value L3B exceed the upper limit of display, the display information is not output or a position of the display information is adjusted. The adjustment of the position of the display information may achieve improving the recognizability of the display information by adjusting the position of the display information or the position of the information display area. If the recognition evaluation score is greater than or equal to the display threshold after the position of the display information is adjusted, the display information with the updated position is output. On the other hand, if the recognition evaluation score still fails to be greater than or equal to the display threshold after the adjustment of the position of the display information and the aforementioned optimization procedure, the display information is not output.

With the use of Formulas 3 through 5, the luminance may be adjusted according to a color ratio of originally schemed display information, such that the optimized display information and the originally schemed display information may have less color difference between each other. On the other hand, when the luminance values calculated in the aforementioned optimization manner (e.g., the optimization manner performed by using Formulas 3 through 5) are greater than the upper limit of display, the optimized display information and the originally schemed display information may have less color difference between each other by deducting the saturated luminance value and adjusting the luminance values of the other colors according to the color ratio of the originally schemed display information.

Figure 2:
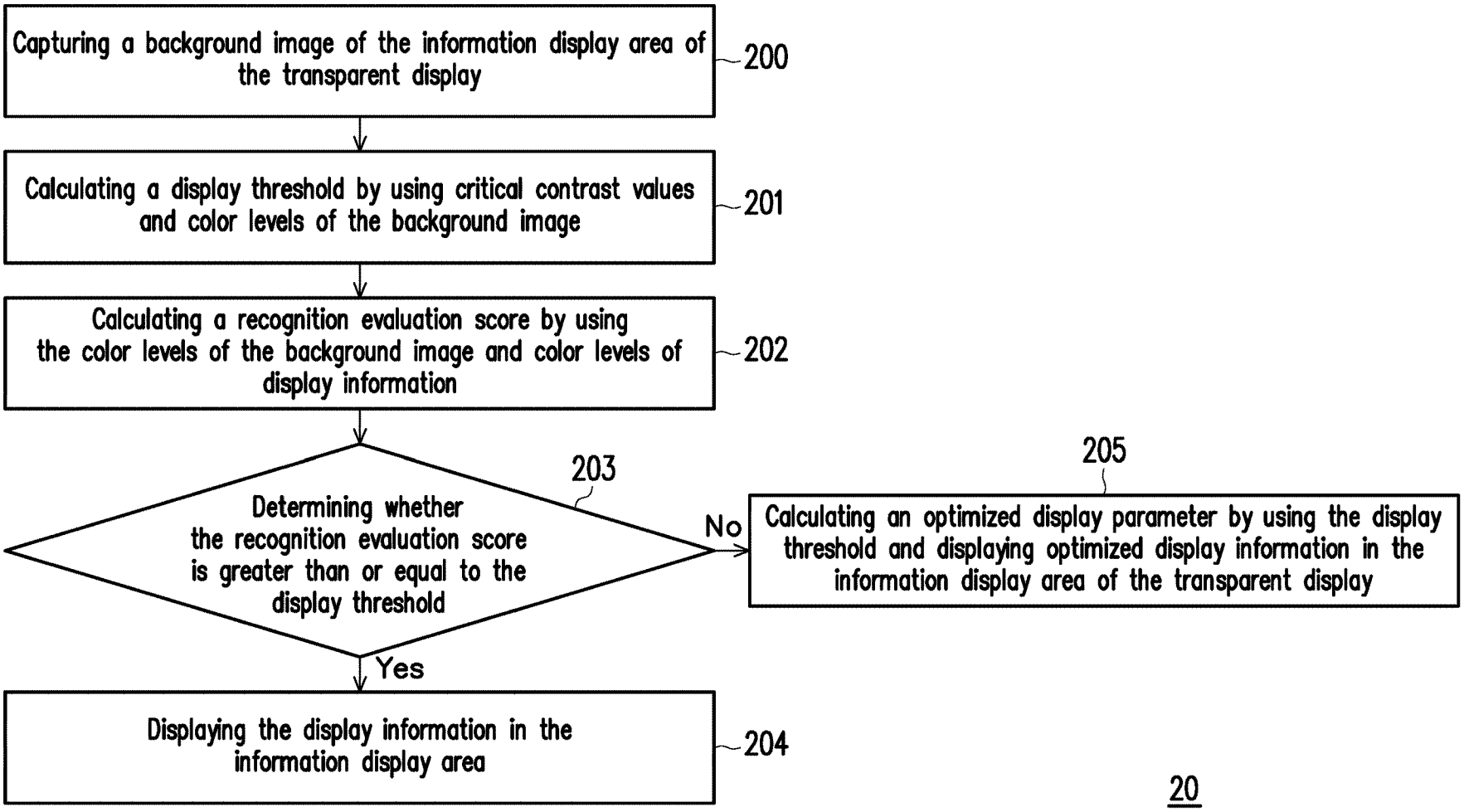
FIG. 2 is a flowchart illustrating an information display method according to an embodiment of the disclosure.

FIG. 2 is a flowchart illustrating an information display method 20 according to an embodiment of the disclosure. Referring to FIG. 1 and FIG. 2, the information display method 20 may be applied to the transparent display 10. The information display method 20 includes steps as follows. A background image of the information display area of the transparent display 10 is captured (step 200). A display threshold is calculated by using critical contrast values and color levels of the background image (step 201). A recognition evaluation score is calculated by using the color levels of the background image and color levels of display information (step 202). Whether the recognition evaluation score is greater than or equal to the display threshold is determined (step 203). If yes (i.e., if the recognition evaluation score is greater than or equal to the display threshold), the display information is displayed in the information display area (step 204). If not (i.e., if the recognition evaluation score is less than the display threshold), an optimized display parameter is calculated by using the display threshold, and optimized display information is displayed in the information display area of the transparent display 10 (step 205). Please refer to the descriptions set forth above for the details related to each step, and the description will not be repeated hereinafter.

Whether the recognizability of the display information is good or poor is judged by comparing the recognition evaluation score and the display threshold. Further, when the recognizability of the display information is judged as poor (for example, it is not easy for the user to recognize the display information), the recognizability of the display information may be improved by adjusting the luminance and/or colors of the display information. Thus, the information display method 20 and the information display system 1 may achieve recognizability.

Figure 3:
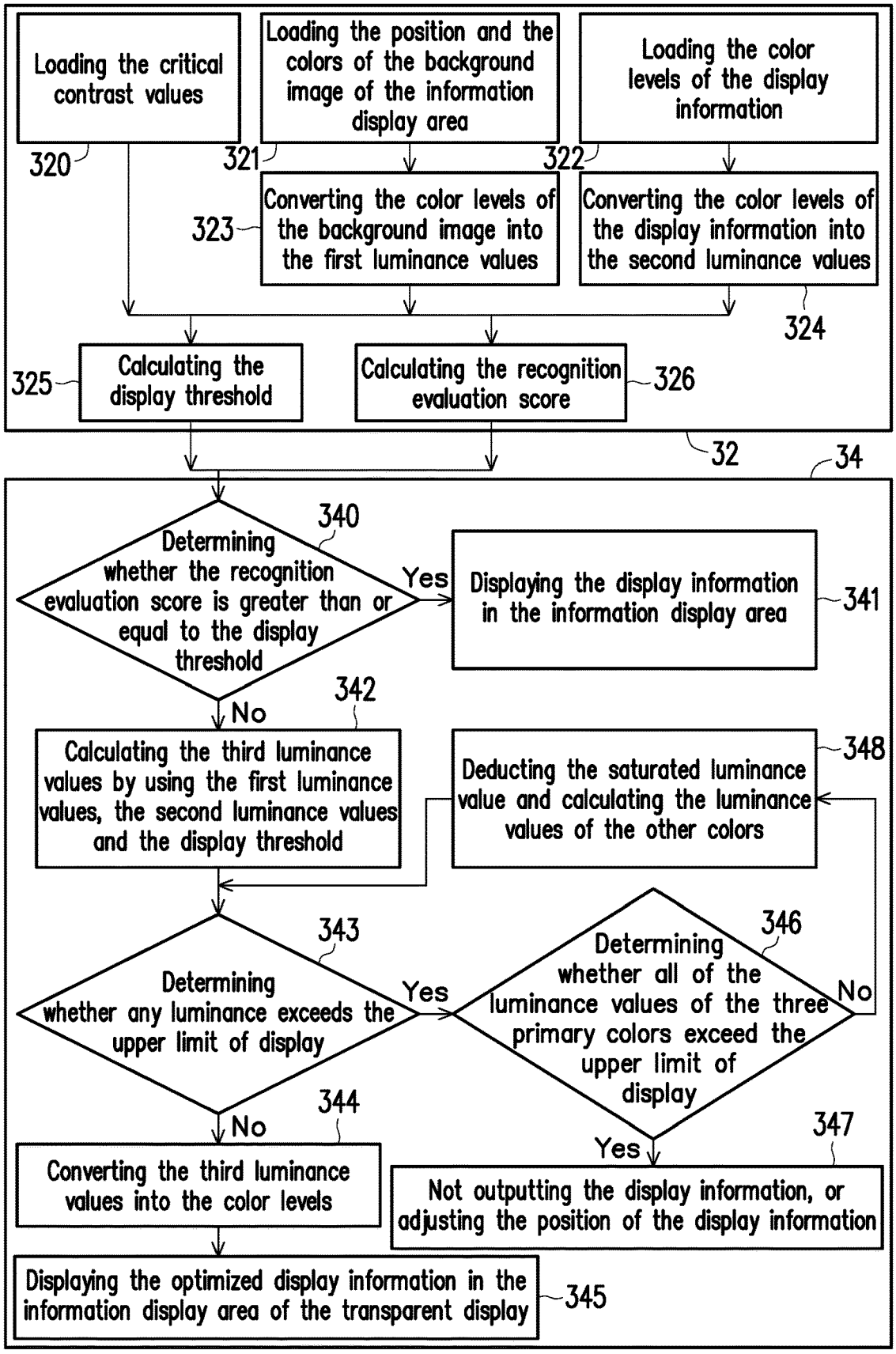
FIG. 3 is a flowchart illustrating a first modified example of the information display method depicted in FIG. 2.

FIG. 3 is a flowchart illustrating a first modified example of the information display method 20 depicted in FIG. 2. Referring to FIG. 3, an information display method 30 includes a pre-processing step 32 and a determination step 34 following the pre-processing step 32.

The pre-processing step 32 may include a plurality of steps of loading information and a plurality of calculation steps (e.g., steps 320 to 326). The pre-processing step 32, for example, corresponds to the steps before step 203 depicted in FIG. 2, wherein steps 325 and 326 included in the pre-processing step 32 are similar to steps 201 and 202 depicted in FIG. 2. To be detailed, the pre-processing step 32 further includes a step of loading the critical contrast values (step 320, for example, referring to Table 1), a step of loading the position and the colors of the background image of the information display area (step 321), a step of loading the color levels of the display information (step 322), a step of converting the color levels of the background image into the first luminance values (step 323) and a step of converting the color levels of the display information into the second luminance values (step 324).

The determination step 34 may include a plurality of determination steps, a plurality of calculation steps and a step of outputting or not outputting the display information (e.g., steps 340 to 348). The determination step 34, for example, corresponds to the steps after step 203 (including step 203) depicted in FIG. 2, wherein steps 340 and 341 are similar to steps 203 and 204 depicted in FIG. 2. To be detailed, the determination step 34 further includes a step of calculating the third luminance values by using the first luminance values, the second luminance values and the display threshold (step 342), a step of determining whether any luminance exceeds the upper limit of display (step 343), a step of converting the third luminance values into the color levels (step 344), a step of displaying the optimized display information in the information display area of the transparent display (step 345), a step of determining whether all of the luminance values of the three primary colors exceed the upper limit of display (step 346), a step of not outputting the display information, or adjusting the position of the display information (step 347) and a step of deducting the saturated luminance value and calculating the luminance values of the other colors (step 348). Please refer to the descriptions set forth above for the details related to each step, and the description will not be repeated hereinafter.

Figure 4:
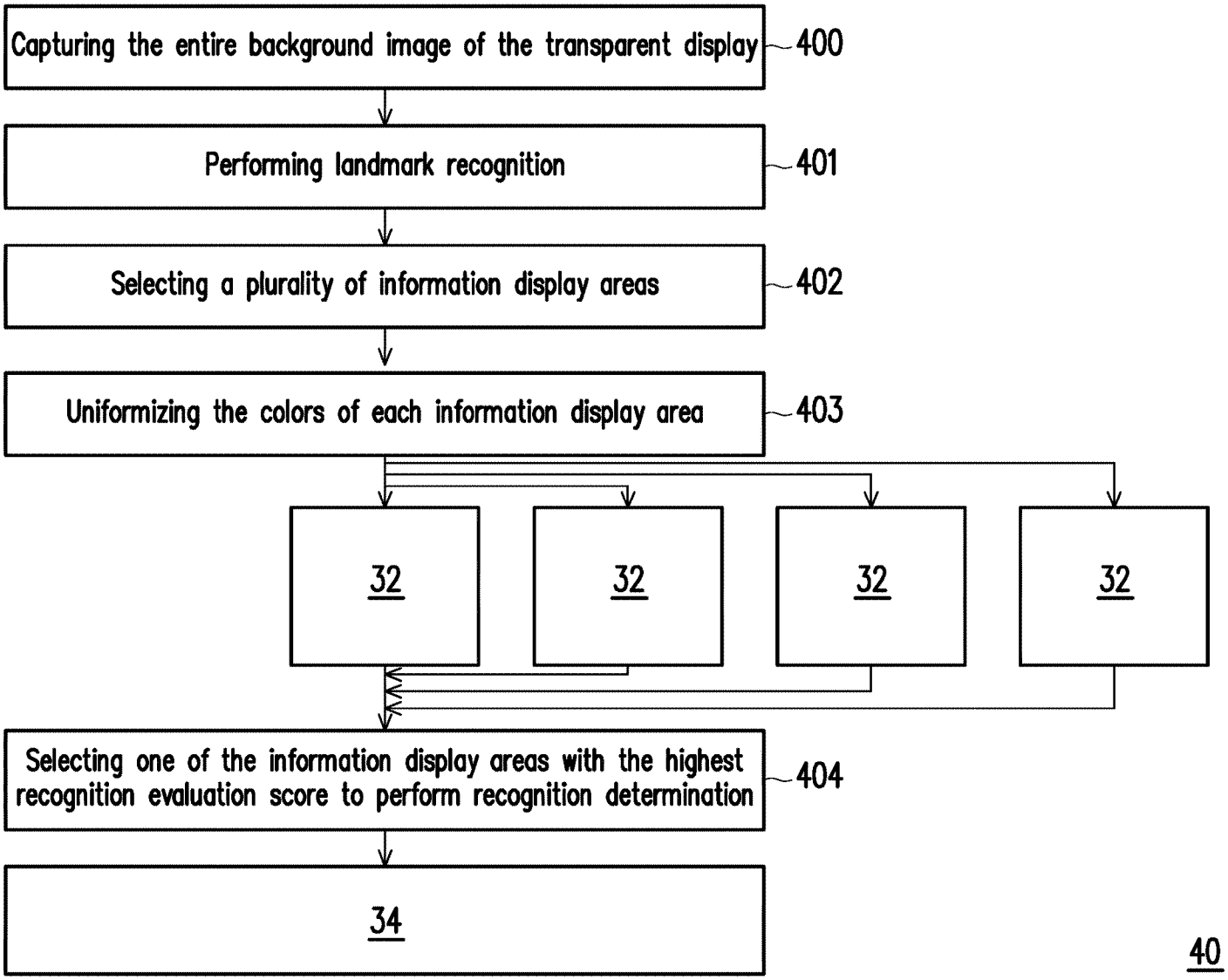
FIG. 4 is a flowchart illustrating a second modified example of the information display method depicted in FIG. 2.

FIG. 4 is a flowchart illustrating a second modified example of the information display method 20 depicted in FIG. 2. FIG. 5A through FIG. 5F illustrate images corresponding to an information display method 40 depicted in FIG. 4. Referring to FIG. 4 through FIG. 5F, the information display method 40 may be applied to mark landmarks in the background image. FIG. 5A through FIG. 5F illustrate the images displayed by the transparent display, wherein the background image includes a tall building (the 85 Sky Tower), a public transportation vehicle and clouds, and the display information includes a text of "85 Sky Tower".

Figure 5A:
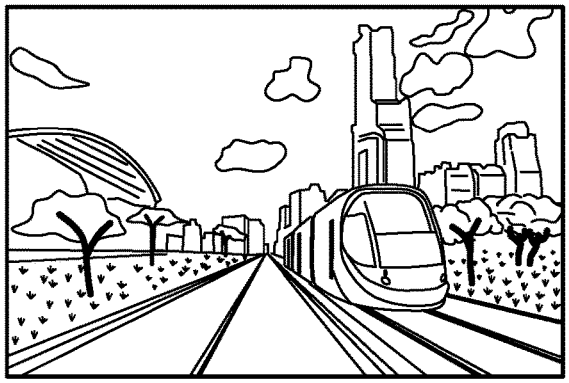
FIG. 5A through FIG. 5F illustrate images corresponding to an information display method depicted in FIG. 4.

The information display method 40 may include a step of capturing the entire background image of the transparent display (referring to FIG. 5A, step 400). For example, the entire background image of the transparent display 10 may be captured by the image capture module 12 depicted in FIG. 1. The entire background image includes all the images that are capable of being displayed by the display area of the transparent display 10.

Figure 5B:
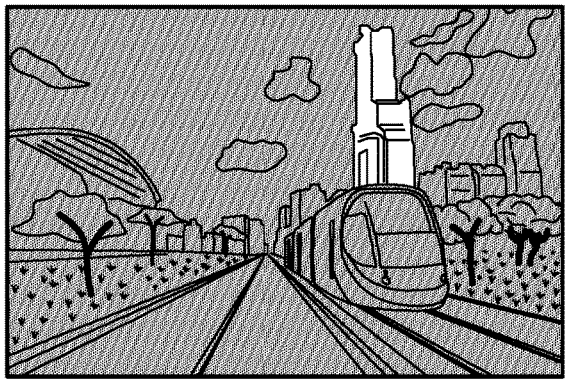
Figure 5C:
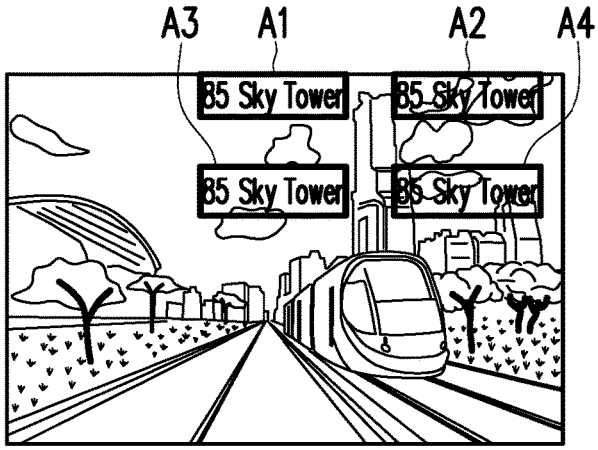

The information display method 40 may further include a step of performing landmark recognition (referring to FIG. 5B, step 401). For example, the landmark recognition may be performed by the calculation module on an image of a target object which is searched in the background image captured by the image capture module 12 by using a target scene recognition technique.

The information display method 40 may further include a step of selecting a plurality of information display areas (referring to FIG. 5C, step 402), such as information display areas A1 to A4. The information display areas may be set as a plurality of areas near the landmarks, and the number of the information display areas may be changed according to demands (e.g., a calculation speed, complexities of the background images and an amount of the text). For example, the number of the information display areas may be 2 to 6, but the disclosure is not limited thereto.

Figure 5D:
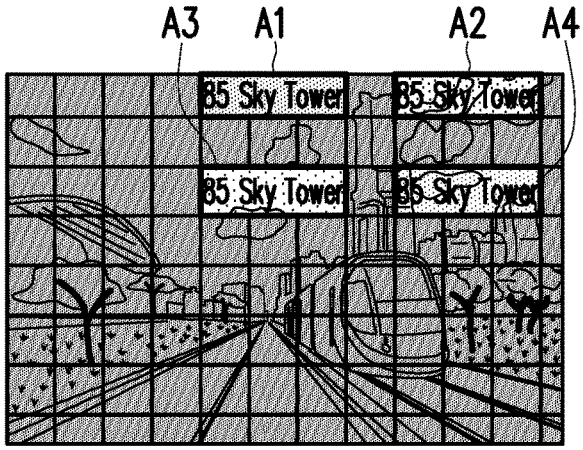

The information display method 40 may further include a step of uniformizing the colors of each information display area (referring to FIG. 5D, step 403). For example, the background image in the information display area A2 includes the blue sky and clouds, i.e., the colors in the information display area A2 include blue and white, and thus, a color obtained after the uniformization of the colors of the information display area A2 is light blue. Since the information display areas have different background colors after the uniformization of the colors, the recognizability of the display information is varied in the information display areas.

Figure 5E:
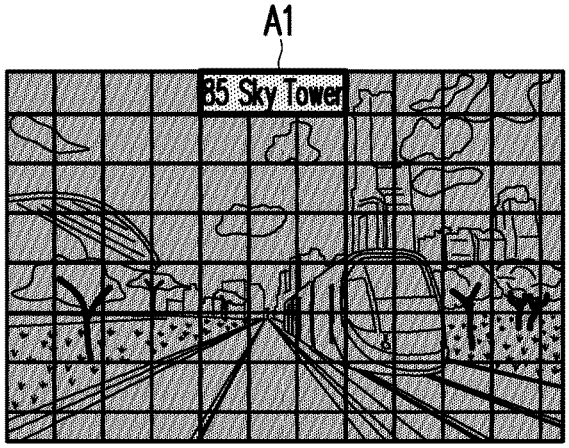
Figure 5F:
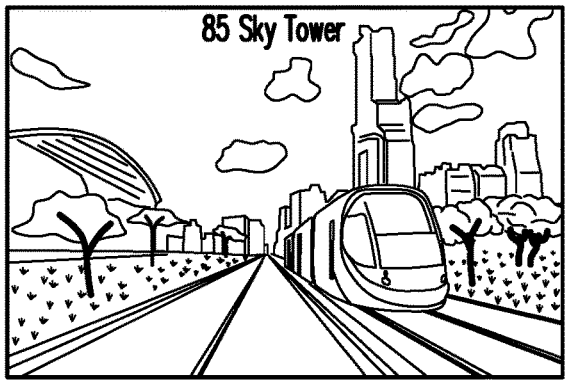

The information display method 40 may further include a step of calculating a recognition evaluation score of each information display area (referring to FIG. 5E, the pre-processing step 32, which may be inferred with reference to the description related to FIG. 3). In FIG. 4, the number of the pre-processing step 32 (i.e., the number of times that the calculation module calculates the recognition evaluation score) may be varied with the number of the information display areas selected in step 402.

The information display method 40 may further include a step of selecting one of the information display areas with the highest recognition evaluation score to perform recognition determination (referring to FIG. 5E, step 404). The recognition determination may be performed on the information display area with the highest recognition evaluation score, such that a probability of directly outputting the display information may be increased, and a probability and/or the number of times of subsequently adjusting the luminance may be reduced.

After step 404, the determination step 34 follows (referring to the description related to FIG. 3 for details). If the recognition evaluation score is greater than or equal to the display threshold, the display information is displayed in each information display area (referring to FIG. 5F).

Figure 6:
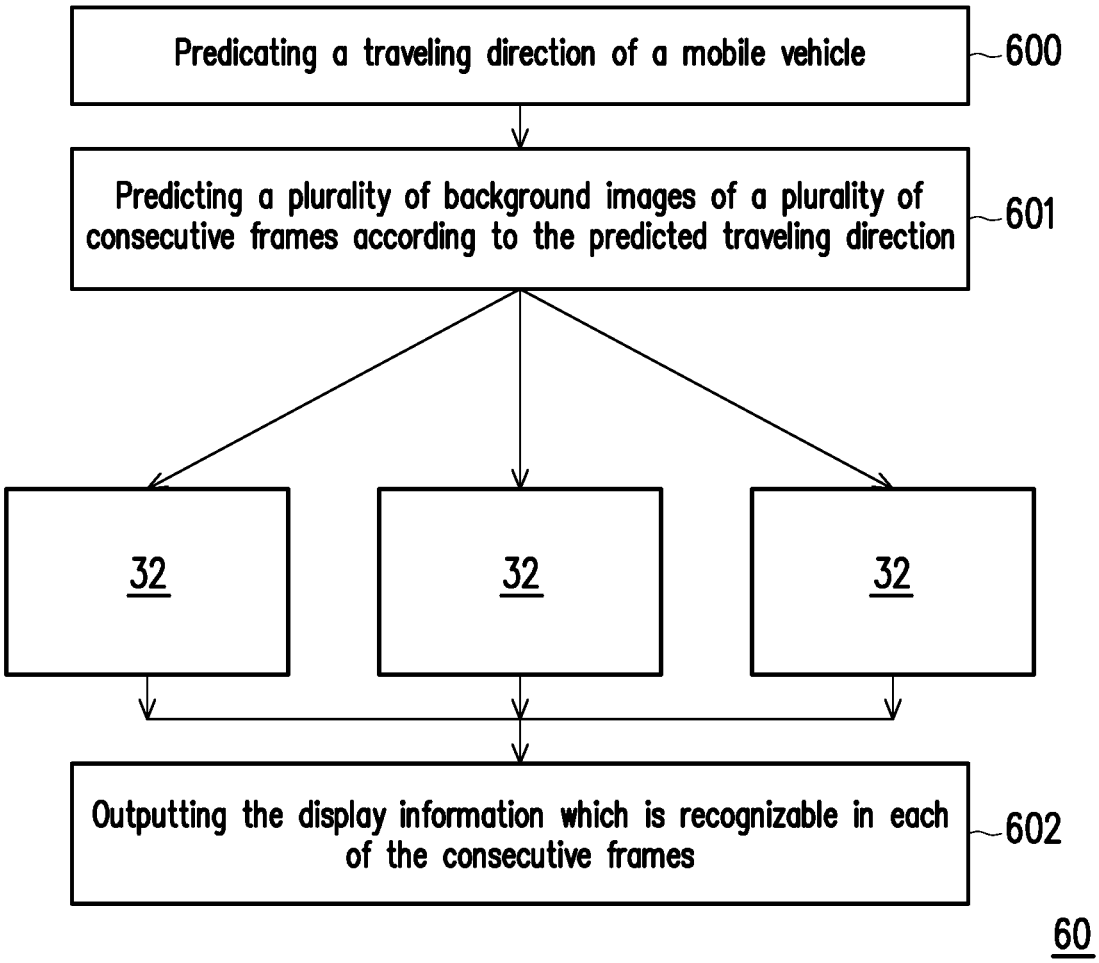
FIG. 6 is a flowchart illustrating a third modified example of the information display method depicted in FIG. 2.

FIG. 6 is a flowchart illustrating a third modified example of the information display method 20 depicted in FIG. 2. Referring to FIG. 6, an information display method 60, for example, may be applied to mark driving information, for example, a speed per hour, but the disclosure is not limited thereto.

When the color and/or the luminance of the background image is changed too frequently, the recognition evaluation score which is less than the display threshold may cause the color levels and/or the luminance of the display information to be changed at all times and may cause discomfort to the user.

In order to improve the aforementioned issue, in a condition that a moving direction of a vehicle is fixed (for example, a moving direction of a vehicle, such as an electric car, an MRT train or a high-speed train), backgrounds that will subsequently appear may be determined in advance, and the colors and the luminance may be calculated to output the display information with preferable recognizability in a plurality of subsequent consecutive frames.

The information display method 60 may include a step of predicating a traveling direction of a mobile vehicle (step 600). For example, the traveling direction of the mobile vehicle may be predicted by the calculation module 16 depicted in FIG. 1.

The information display method 60 may further include a step of predicting a plurality of background images of a plurality of consecutive frames according to the predicted traveling direction (step 601). For example, a plurality of background images of a plurality of consecutive frames may be predicted by the calculation module 16 depicted in FIG. 1.

The information display method 60 may further include a step of calculating a plurality of display thresholds and a plurality of recognition evaluation scores of the consecutive frames (the pre-processing step 32, which may be inferred with reference to the description related to FIG. 3). In FIG. 6, the calculation module 16, for example, obtains, 3 background images of 3 consecutive frames and calculates a display threshold and a recognition evaluation score corresponding to each of the background images (the display threshold and the recognition evaluation score may be calculated corresponding each of the background images by 3 pre-processing steps 32). However, the number of the consecutive frames which are predicted by the calculation module 16 is not limited herein.

The information display method 60 may further include a step of outputting the display information having the recognition evaluation score which is greater than or equal to the display threshold in each of the consecutive frames (step 602).

By calculating the display information with preferable recognizability in each of the consecutive frames, the display information may be maintained to have the same luminance and the color levels during periods of the consecutive frames, thereby reducing a change frequency of the color levels and/or the luminance of the display information, while improving comfort for the user when recognizing the display information.

Figure 7:
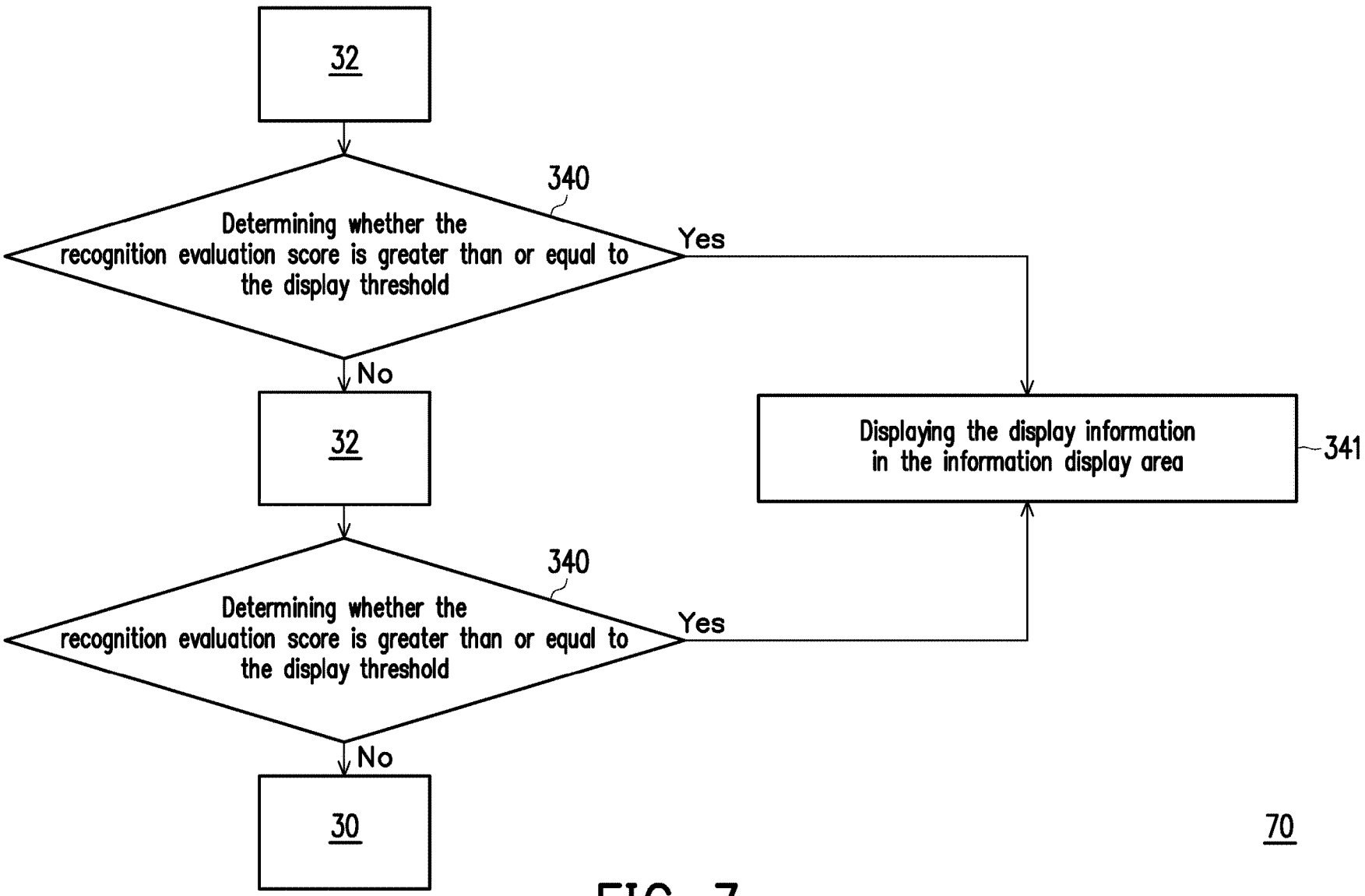
FIG. 7 is a flowchart illustrating a fourth modified example of the information display method depicted in FIG. 2.

FIG. 7 is a flowchart illustrating a fourth modified example of the information display method 20 depicted in FIG. 2. Referring to FIG. 7, an information display method 70 may also be applied to mark driving information, but the disclosure is not limited thereto.

In a condition that a traveling direction of a vehicle (e.g., an autonomous vehicle) is unable to be predicted, a change frequency of the color levels and/or the luminance of the display information may be reduced by delaying the change of the color levels. The color levels and/or the luminance of the display information is not changed until all of the recognition evaluation scores of the consecutive frames are less than the display thresholds.

The information display method 70 may include the pre-processing step 32 and step 340 as illustrated in FIG. 3. In step 340, if the determination is yes (i.e., if the recognition evaluation score is greater than or equal to the display threshold), step 341 follows. If the determination is no (i.e., if the recognition evaluation score is less than the display threshold), the pre-processing step 32 and step 340 are again performed. When the step 340 is performed for the second time, if the determination is yes (i.e., if the recognition evaluation score is greater than or equal to the display threshold), step 341 follows. If the determination is no (i.e., if the recognition evaluation score is less than the display threshold), the information display method 30 (including the pre-processing step 32 and the determination step 34) as depicted in FIG. 3 follows. It should be mentioned that the number of times for performing the pre-processing step 32 and step 340 of the information display method 70 may be changed according to demands and is not limited to the embodiment illustrated in FIG. 7.

Figure 8:
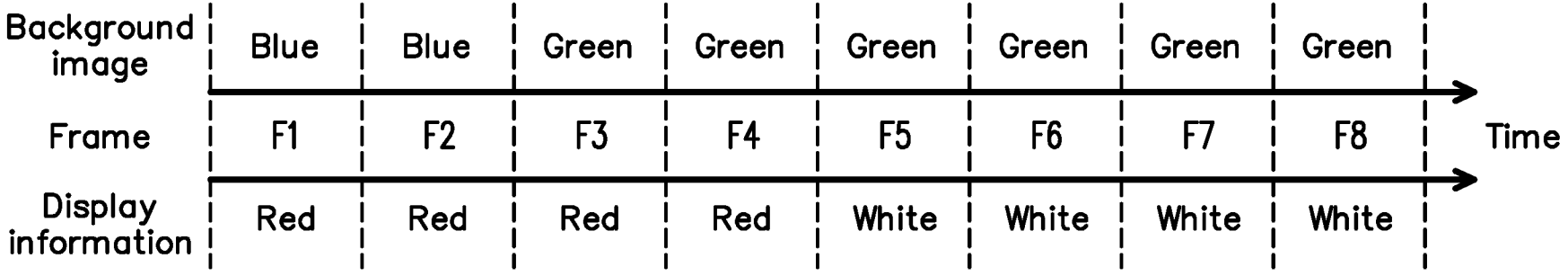
FIG. 8 and FIG. 9 respectively illustrate two examples applying the information display method depicted in FIG. 7.
Figure 9:
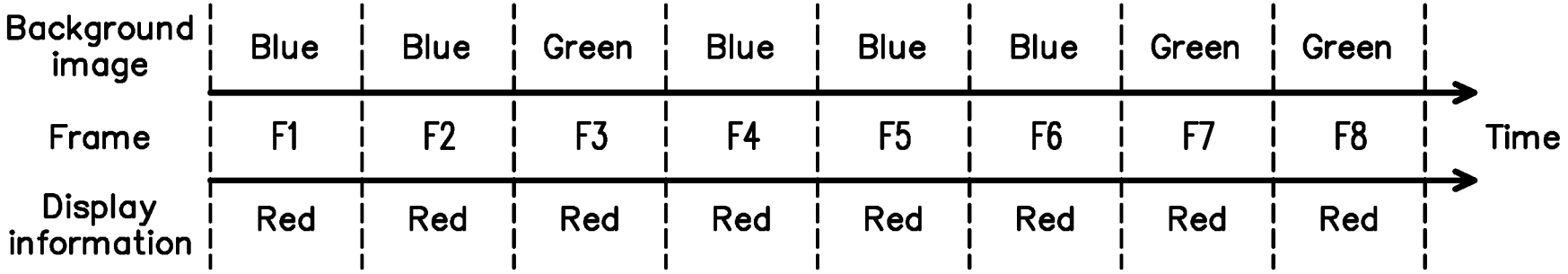

FIG. 8 and FIG. 9 respectively illustrate two examples applying the information display method 70 depicted in FIG. 7. In FIG. 8 and FIG. 9, 8 consecutive frames (e.g., frames F1 to F8) are schematically illustrated, and it is assumed that the display information has a preferable recognizability (i.e., having a recognition evaluation score greater than or equal to a display threshold) when a background image is in blue and the display information is in red, while it is difficult for the display information to be recognized (i.e., due to the recognition evaluation score being less than the display threshold) when the background image is in green and the display information is in red, but the display information may have a preferable recognizability by optimizing the display information (for example, by changing the display information from in red to in white).

With reference to FIG. 8, in the frame F3, the background image is changed from in blue to in green and has a poor recognizability at this time, and the change of the color of the display information may be delayed. In the frame F4, the background image is still in green, and the recognizability has been determined as poor for twice consecutively, but the change of the color of the display information may still be delayed (the change of the color of the display information may be delayed for the second time). In the frame F5, the background image is still in green. Under an architecture that N is 3, the display information is optimized when the recognition evaluation score is determined as being less than the display threshold for the third time. Thus, in the frame F5, the display information is changed from in red to in white, thereby improving the recognizability of the display information. In an embodiment, a total time of delaying the change of the color levels (which is a total time of the frames F3 and F4 in FIG. 8, for example) may be, for example, less than 50 ms, thereby reducing the situation that the user perceives the display information with poor recognizability, but the disclosure is not limited thereto.

With reference to FIG. 9, since the background image is changed from in green to in blue after the change of the color of the display information has been delayed for the second time, namely, in the frame F4, the display information has a preferable recognizability, and the color of the display information is maintained in red.

According to FIG. 8 and FIG. 9, when the recognition evaluation scores are less than the display thresholds in N consecutive frames, the optimized display parameter is calculated by using the display threshold in the Nth frame (i.e., the optimization of the display information of the previous (N−1) times is delayed), and the optimized display information is displayed in the information display area of the transparent display. In the present embodiment, N is 3, namely, when the recognition evaluation score is determined as being less than the display threshold for three times consecutively, the optimization of the display information of the previous two times is delayed, and the display information is optimized when the recognizability score is determined as being less than the display threshold at the third time, however, the value of N is not limited herein. In other embodiments, N may fall within a range from 2 to 5.

Figure 10:
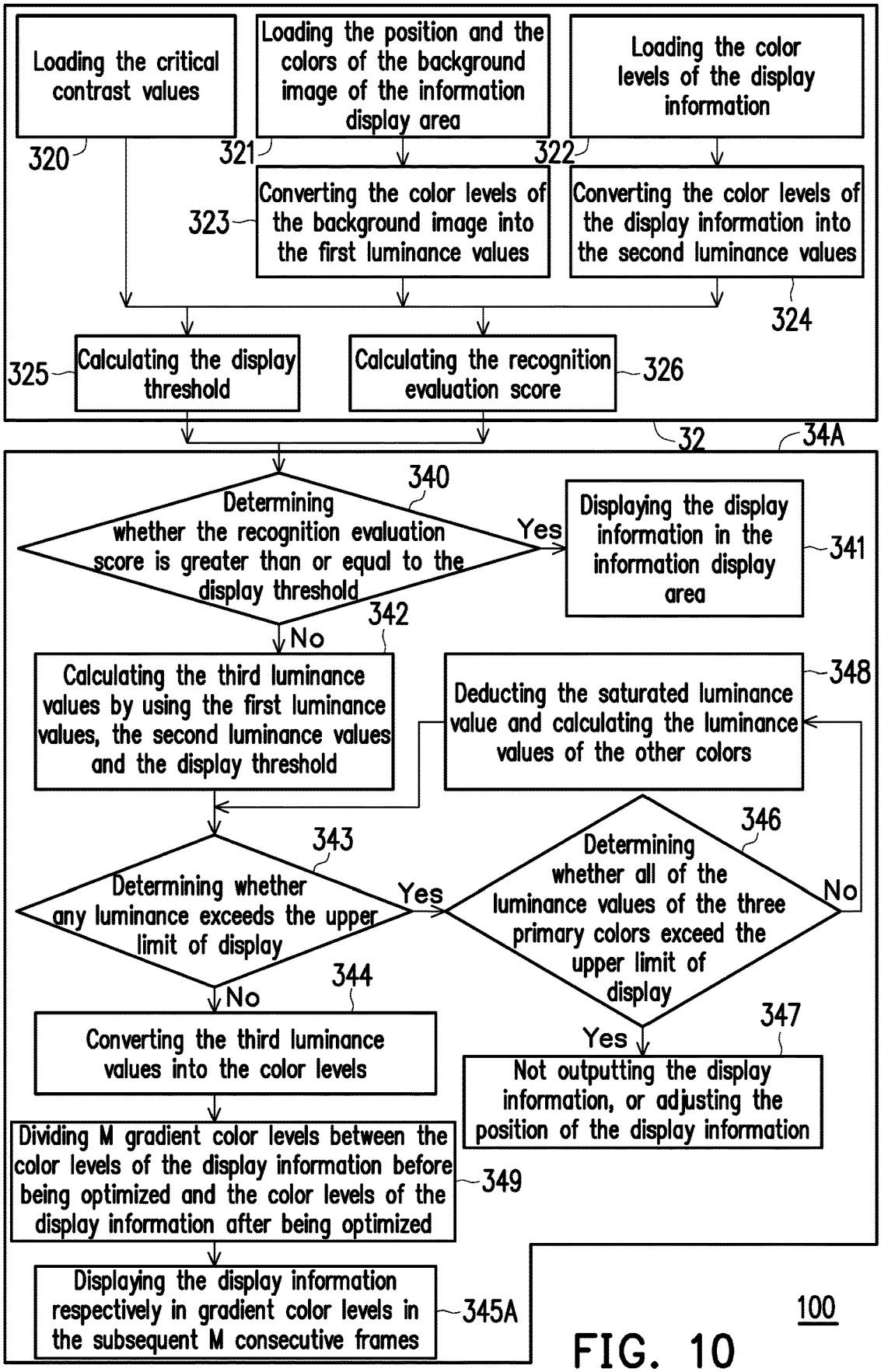
FIG. 10 is a flowchart illustrating a fifth modified example of the information display method depicted in FIG. 2.

FIG. 10 is a flowchart illustrating a fifth modified example of the information display method 20 depicted in FIG. 2. Referring to FIG. 10, an information display method 100 may also be applied to mark driving information, but the disclosure is not limited thereto.

In a condition that a traveling direction of a vehicle (e.g., an autonomous vehicle) is unable to be predicted, the viewing discomfort of the user may be mitigated by modulating the display information by means of gradiently changing the color levels.

The main difference between the information display method 100 and the information display method 30 depicted in FIG. 3 lies in a determination step 34A. In the determination step 34A, step 349 is further included between step 344 and step 345A. In step 349, M gradient color levels are divided between the color levels of the display information before being optimized and the color levels of the display information after being optimized, wherein M may fall within a range from 2 to 5. Moreover, in step 345A, the display information may be displayed respectively in gradient color levels in the subsequent M consecutive frames.

Figure 11:
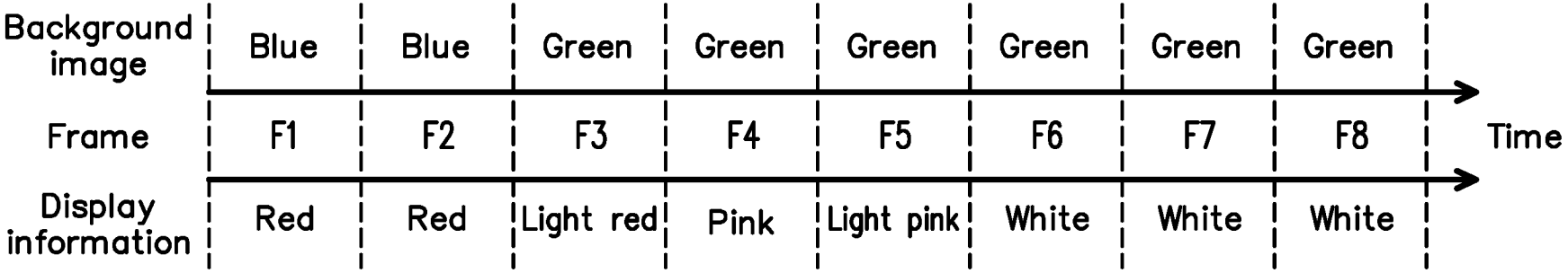
FIG. 11 respectively illustrate an example applying the information display method depicted in FIG. 10.

FIG. 11 illustrates an example applying the information display method 100 depicted in FIG. 10. In FIG. 11, 8 consecutive frames (e.g., frames F1 to F8) are schematically illustrated, and it is assumed that display information has a preferable recognizability (i.e., having a recognition evaluation score greater than or equal to a display threshold) when the background image is in blue and the display information is in red, and it is difficult for the display information to be recognized (the recognition evaluation score is less than the display threshold) when the background image is in green and the display information is in red, but the display information may have a preferable recognizability by optimizing the display information (for example, by changing the display information from in red to in white).

With reference to FIG. 11, starting from the frame F3, it is difficult for the display information to be recognized (the recognition evaluation score is less than the display threshold), and in this circumstance, the display information before being optimized is in red, and the display information after being optimized is in white. If M=3, i.e., three color levels that are equidistantly inserted are gradient colors, the colors of the display information is light red, pink and light pink sequentially in the frames F3, F4 and F5, and the color of the display information is white in the frame F6. For example, it is assumed that the color levels of the display information originally schemed to be output are (120, 40, 60), the color levels of the optimized display information are (240, 80, 120), and M=3, the three color levels that are equidistantly inserted are gradient colors. Under such architecture, in the frames F3, F4 and F5, the color levels of the display information are (150, 50, 75), (180, 60, 90) and (210, 70, 105), respectively, and in the frame F6, the color levels of the display information are (240, 80, 120).

In the information display method and the information display system of one of the embodiments of the disclosure, the recognizability of display information can be improved by adjusting the luminance and/or the color levels of the display information when the recognizability of display information is poor. In an embodiment, the luminance can be adjusted according to the colors of the originally schemed display information, such that the optimized display information and the originally schemed display information can have less color difference between each other. In an embodiment, when the calculated luminance value is greater than the upper limit of display, the optimized display information and the originally schemed display information can have less color difference between each other by deducting the saturated luminance value and adjusting the luminance values of the other colors according to the color ratio of the originally schemed display information. In an embodiment, by calculating the display information with preferable recognizability in the subsequent consecutive frames, the display information can be maintained in the same luminance and the color levels during the periods of the consecutive frames, thereby reducing the change frequency of the color levels and/or the luminance of the display information, while improving the comfort for the user when recognizing the display information. In an embodiment, the discomfort caused by an overly large change in the color levels or an overly high change frequency can be mitigated by delaying the change of the color levels or by means of gradiently modulating the color levels. In an embodiment, the recognizability of the display information can be improved by adjusting the position of the display information.

It will be apparent to those skilled in the art that various modifications and variations can be made to the structure of the disclosed embodiments without departing from the scope or spirit of the disclosure. In view of the foregoing, it is intended that the disclosure cover modifications and variations of this disclosure provided they fall within the scope of the following claims and their equivalents.

What is claimed is:

1. An information display method, applied in a transparent display, comprising:

capturing a background image of an information display area of the transparent display;

calculating a display threshold by using critical contrast values and color levels of the background image according to formula 1:

$$\text{Display threshold} = \frac{L1R*(RR+RG+RB)+L1G*(GR+GG+GB)+L1B*(BR+BG+BB)}{3*(L1R+L1G+L1B)}$$

wherein the color levels of the background image comprise a red color level, a green color level and a blue color level of the background image, and L1R, L1 G and L1B of the formula 1 are luminance values respectively corresponding to the red color level, the green color level and the blue color level of the background image;

the critical contrast values comprise RR, RG, RB, GR, GG, GB, BR, BG and BB of the formula 1, RR is a critical contrast value corresponding to a red color of the background image and a red color of a display information, RG is a critical contrast value corresponding to a red color of the background image and a green color of the display information, RB is a critical contrast value corresponding to a red color of the background image and a blue color of the display info nation, GR is a critical contrast value corresponding to a green color of the background image and a red color of the display information, GG is a critical contrast value corresponding to a green color of the background image and a green color of the display information, GB is a critical contrast value corresponding to a green color of the background image and a blue color of the display information, BR is a critical contrast value corresponding to a blue color of the background image and a red color of the display information, BG is a critical contrast value corresponding to a blue color of the background image and a green color of the display information, and BB is a critical contrast value corresponding to a blue color of the background image and a blue color of the display information;

calculating a recognition evaluation score by using the color levels of the background image and color levels of display information; and determining whether the recognition evaluation score is greater than or equal to the display threshold, if the recognition evaluation score is greater than or equal to the display threshold, displaying the display information in the information display area, and if the recognition evaluation score is less than the display threshold, calculating an optimized display parameter by using the display threshold and displaying optimized display information in the information display area of the transparent display.

2. The information display method according to claim 1, wherein the critical contrast values comprise a red critical contrast value, a green critical contrast value and a blue critical contrast value, and the critical contrast values fall within a range from 1.084 to 1.978, and the critical contrast values are statistically calculated according to monochrome contrast values capable of being clearly recognized by human eyes through a human factor experiment.

3. The information display method according to claim 1, further comprising:

converting the color levels of the background image into first luminance values; and converting the color levels of the display information into second luminance values, wherein the recognition evaluation score is calculated by a sum of the first luminance values and the second luminance values divided by the first luminance values.

4. The information display method according to claim 3, wherein the optimized display parameter comprises third luminance values calculated by using the first luminance values, the second luminance values and the display threshold, the third luminance values comprise a red luminance value, a green luminance value and a blue luminance value, and the information display method further comprises:

determining whether one of the red luminance value, the green luminance value and the blue luminance value exceeds an upper limit of display, if none of the red luminance value, the green luminance value and the blue luminance value exceed the upper limit of display, converting the third luminance values into color levels and displaying the optimized display information in the information display area of the transparent display, if one of the red luminance value, the green luminance value and the blue luminance value exceeds the upper limit of display, determining whether all of the red luminance value, the green luminance value and the blue luminance value exceed the upper limit of display, if one of the red luminance value, the green luminance value and the blue luminance value does not exceed the upper limit of display, deducting a saturated luminance value, calculating the luminance values of other colors, converting the calculated luminance values into color levels and displaying the optimized display information in the information display area of the transparent display, and if all of the red luminance value, the green luminance value and the blue luminance value exceed the upper limit of display, not outputting the display information or adjusting a position of the display information.

5. The information display method according to claim 4, wherein if none of the red luminance value, the green luminance value and the blue luminance value exceed the upper limit of display, after converting the third luminance values into the color levels, M gradient color levels are divided between the color levels of the display information before being optimized and the color levels of the display information after being optimized, and the display information is displayed respectively in gradient color levels in subsequent M consecutive frames, wherein M falls within a range from 2 to 5.

6. The information display method according to claim 1, further comprising:

capturing the entire background image of the transparent display;

performing landmark recognition;

selecting a plurality of information display areas;

uniformizing colors of each of the information display areas;

calculating a recognition evaluation score of each of the information display areas; and selecting one of the information display areas with a highest recognition evaluation score to perform recognition determination.

7. The information display method according to claim 1, further comprising:

predicting a traveling direction of a mobile vehicle;

predicting a plurality of background images of a plurality of consecutive frames according to the predicted traveling direction;

calculating a plurality of display thresholds and a plurality of recognition evaluation scores of the consecutive frames; and outputting display information which is recognizable in the consecutive frames.

8. The information display method according to claim 1, wherein if the recognition evaluation score is less than the display threshold, and the recognition evaluation score in each of N consecutive frames is less than the display threshold, the optimized display parameter is calculated by using the display threshold in the Nth frame, and the optimized display information is displayed in the information display area of the transparent display, wherein N falls within a range from 2 to 5.

9. An information display system, comprising:

a transparent display;

an image capture module, capturing a background image of an information display area of the transparent display;

a database, storing critical contrast values and a luminance-color level conversion curve; and a calculation module, calculating a display threshold by using the critical contrast values and color levels of the background image, calculating a recognition evaluation score by using the color levels of the background image and color levels of display information, and further determining whether the recognition evaluation score is greater than or equal to the display threshold, if the recognition evaluation score is greater than or equal to the display threshold, displaying the display information in the information display area, and if the recognition evaluation score is less than the display threshold, calculating an optimized display parameter by using the display threshold, and displaying optimized display information in the information display area of the transparent display.

10. The information display system according to claim 9, wherein the critical contrast values comprise a red critical contrast value, a green critical contrast value and a blue critical contrast value, and the critical contrast values fall within a range from 1.084 to 1.978, and the critical contrast values are statistically calculated according to monochrome contrast values capable of being clearly recognized by human eyes through a human factor experiment.

11. The information display system according to claim 9, wherein the calculation module converts the color levels of the background image into first luminance values and converts the color levels of the display information into second luminance values, wherein the recognition evaluation score is calculated by a sum of the first luminance values and the second luminance values divided by the first luminance values.

12. The information display system according to claim 11, wherein the optimized display parameter comprises third luminance values calculated by using the first luminance values, the second luminance values and the display threshold, the third luminance values comprise a red luminance value, a green luminance value and a blue luminance value, and the calculation module further determines whether one of the red luminance value, the green luminance value and the blue luminance value exceeds an upper limit of display, wherein if none of the red luminance value, the green luminance value and the blue luminance value exceed the upper limit of display, the calculation converts the third luminance values into color levels, and displays the optimized display information in the information display area of the transparent display, if one of the red luminance value, the green luminance value and the blue luminance value does not exceed the upper limit of display, the calculation module further determines whether all of the red luminance value, the green luminance value and the blue luminance value exceed the upper limit of display, if one of the red luminance value, the green luminance value and the blue luminance value does not exceed the upper limit of display, the calculation module deducts a saturated luminance value and calculates the luminance values of other colors, and the calculation module further converts the calculated luminance values into color levels and displays the optimized display information in the information display area of the transparent display, and if all of the red luminance value, the green luminance value and the blue luminance value exceed the upper limit of display, the display information is not output or a position of the display information is adjusted.

13. The information display system according to claim 12, if none of the red luminance value, the green luminance value and the blue luminance value exceed the upper limit of display, after the third luminance values are converted into the color levels, the calculation module divides M gradient color levels between the color levels of the display information before being optimized and the color levels of the display information after being optimized and displays the display information respectively in gradient color levels in subsequent M consecutive frames, wherein M falls within a range from 2 to 5.

14. The information display system according to claim 9, wherein the image capture module further captures the entire background image of the transparent display, and the calculation module further performs landmark recognition, selects a plurality of information display areas, uniformizes colors of each of the information display areas, calculates a recognition evaluation score of each of the information display areas and selects one of the information display areas with a highest recognition evaluation score to perform recognition determination.

15. The information display system according to claim 9, wherein the calculation module further predicts a traveling direction of a mobile vehicle, predicts a plurality of background images of a plurality of consecutive frames according to the predicted traveling direction, calculates a plurality of display thresholds and a plurality of recognition evaluation scores of the consecutive frames and outputs display information in the consecutive frames having recognition evaluation scores greater than or equal to the display thresholds.

16. The information display system according to claim 9, wherein if the recognition evaluation score is less than the display threshold, and the recognition evaluation score in each of N consecutive frames is less than the display threshold, the optimized display parameter is calculated by using the display threshold in the Nth frame, and the optimized display information is displayed in the information display area of the transparent display, wherein N falls within a range from 2 to 5.

* * * * *